United States Patent [19]

Lane et al.

[11] Patent Number: 5,014,470

[45] Date of Patent: May 14, 1991

[54] MOBILE HOME STRAP EXTENDER

[76] Inventors: George R. Lane, 4416 Springhill Dr., Hurst, Tex. 76054; Frank M. McDuff, 7437 Yolanda Dr., Fort Worth, Tex. 76112

[21] Appl. No.: 550,646

[22] Filed: Jul. 10, 1990

[51] Int. Cl.[5] ..... E04B 7/00

[52] U.S. Cl. ..... 52/23; 52/DIG. 11; 52/148

[58] Field of Search ..... 52/DIG. 11, 713, 23, 52/148, 127.1, 4; 24/16 R, 17 R, 20 W, 20 R, 20 CW, 20 EE, 21, 23 EE, 265 R; 410/96, 100

[56] References Cited

U.S. PATENT DOCUMENTS 146,911 1/1874 Jordan ..... 24/21

3,054,151 9/1962 Shankland ..... 52/23

3,403,487 10/1968 Docter ..... 52/148

*Primary Examiner*—Richard E. Chilcot, Jr.

*Assistant Examiner*—Robert J. Canfield

*Attorney, Agent, or Firm*—James E. Bradley

[57] ABSTRACT

A method and apparatus for anchoring a mobile home utilizes an extender strap. The extender strap connects between a conventional anchor buried in the ground and an overhead tie that has ends that have been cut off too short. The extender strap secures to an extender plate by a loop that passes through a slot in the extender plate. The loop is crimped. The shortened end of the overhead tie loops through another slot in the extender plate. This end is also crimped. Reinforcing plates will be bent and located in the loops prior to crimping. The lower end of the extender strap connects to an anchor in a conventional manner.

6 Claims, 2 Drawing Sheets

MOBILE HOME STRAP EXTENDER

BACKGROUND OF THE INVENTION

1. Field of the Invention

This invention relates in general to a method and apparatus for anchoring a mobile home, and in particular to a strap extender for anchoring a mobile home in which the factory installed overhead ties have been previously cut too short for connection to a conventional anchor.

2. Description of the Prior Art

In a number of states, safety rules require that mobile homes be anchored to reduce the chances of them blowing over in high winds. One specification requires that straps extend over the structure of the mobile home. These overhead ties are steel straps which are installed during manufacturing. The siding and roof are located over the overhead ties, with the ties sandwiched between the mobile home upper frame structure and the siding and roof. A number of the ties will be placed along the length of the mobile home. The overhead ties are of flexible sheet metal and are approximately 1¼ inches in width. The ends of the overhead ties protrude below the lower edge of the mobile home and secure to an anchor embedded in the ground. Also, normally frame straps will extend from the anchor to the I-beam frame of the mobile home.

When a mobile home is moved, sometimes the mover will cut the ends of the overhead ties rather than going through the more time consuming process of disconnecting the lower ends from the anchors. This particularly occurs if the mobile home is being repossessed. When setting up the mobile home again, the ends of the overhead ties may be too short to connect to an anchor.

This presents a problem. New overhead ties often cannot be placed over the top of the mobile home because of shingles on the roof, or overhanging eaves. The frame straps from the anchor to the I-beam frame do not prevent a strong wind from ripping off the upper structure of the mobile home. Some state specifications require building a block wall around the edges of the mobile home if overhead ties cannot be used. These are expensive and do not resist high winds as well as overhead ties.

In some areas, connectors have been used to extend the length of straps that have been cut. The ties or straps will insert through the connector in a general "S" configuration. While these extend the length, these types of connectors do not provide sufficient strength to meet specifications in some states.

SUMMARY OF THE INVENTION

In this invention, a steel extender strap is used. This steel extender strap connects to a steel extender plate. The plate has two slots. The steel extender strap loops through one of the slots. The end of the steel extender strap will be crimped. The lower end of the overhead tie will insert through the other slot in the extender plate. This end is also crimped into a loop. The extender strap then connects to the anchor in a conventional manner.

Preferably, a reinforcing piece will be placed in the loop of the extender strap and of the overhead tie. The reinforcing piece locates within the loop to provide reinforcement. The length of the reinforcing piece is selected so that it does not get crimped.

DETAILED DESCRIPTION OF THE INVENTION

Figure 1:
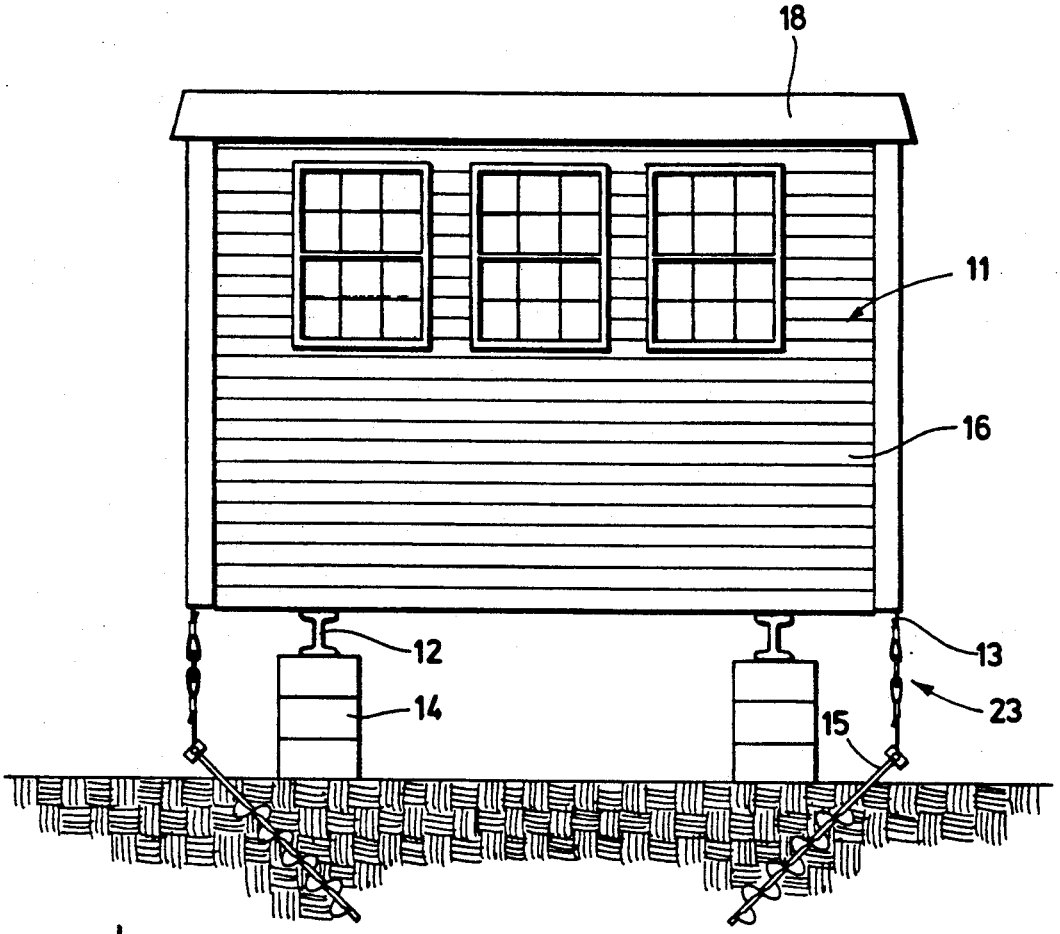
FIG. 1 is a schematic end view of a mobile home having an extender assembly constructed in accordance with this invention.

Referring to FIG. 1, mobile home 11 is a conventional transportable building. Mobile home 11 has a lower metal I-beam frame 12 that will be supported on wheels (not shown) while the mobile home 11 is being transported. Frame 12 is shown resting on blocks 14 in FIG. 1.

Depending on its length, mobile home 11 will have a number of overhead ties 13. Overhead ties 13 are flexible sheet metal straps which extend up over the wooden framework of the mobile home below the siding 16 and under the roof 18. A lower portion of the overhead tie 13 will extend downward from each side edge of the mobile home 11 and be anchored by a conventional anchor 15.

Normally, the overhead tie 13 will connect directly to the anchors 15. The lower ends of the overhead tie 13, however, have been cut too short when this invention is used. The ends will not reach the anchors 15. An extender assembly 23 of this invention is used to connect the lower ends of the overhead tie 13 to the anchor 15.

Figure 2:
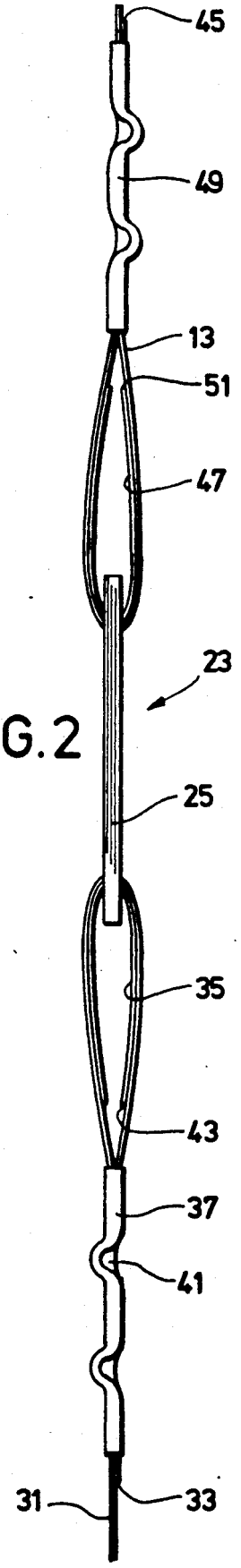
FIG. 2 is an enlarged side view of the extender assembly of FIG. 1.
Figure 3:
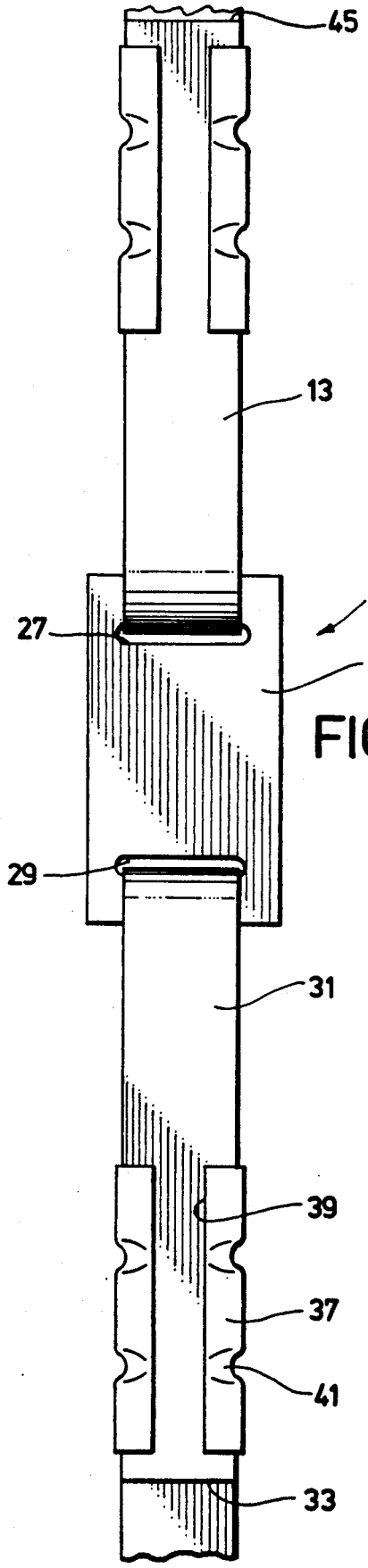
FIG. 3 is a front view of the extender assembly of FIG. 2.

Referring to FIGS. 2 and 3, the extender assembly 23 includes a rigid metal extender plate 25. Plate 25 is a rectangular and slightly greater in width than the overhead tie 13. It is considerably greater in thickness than the overhead tie 13. Extender plate 25 has an upper slot 27 and a lower slot 29. The slots 27, 29 are spaced from each other and are parallel to each other.

An extender strap 31 has an upper end 33 that will loop through the lower slot 29. The end 33 is bent over and doubled back into contact with the extender strap 31, defining a loop. A lower reinforcing piece 35 will locate within this loop. The lower reinforcing piece 35 is of the same material as the extender strap 31 and the overhead tie 13. It is bent in a doubled back form also. It locates in contact with the load bearing edge of the lower slot 29.

A lower crimp seal 37 will be placed on the extender strap 33 before it is looped through the lower slot 29. The lower crimp seal 37 is a conventional deformable metal seal. It has a longitudinal slot 39 on one side. It will locate over the double backed portion of the extender strap upper end 33 with the extender strap 31. A conventional crimping tool (not shown) will crimp the upper end 33 to the extender strap 31. The crimping tool forms deformations 41 during this procedure. The length of the reinforcing piece 35 is selected so that it will not be crimped by the crimp seal 37. Its ends 43 will be within the loop and spaced above the upper end of the crimp seal 37.

The overhead tie 13 has a lower end 45 on each side of the mobile home 11. The lower end 45 inserts through the upper slot 27 and is doubled back. Prior to being doubled back, an upper reinforcing piece 47 will be inserted also into slot 27. The upper reinforcing piece 47 is doubled back within the loop being formed by the bent over lower end 45. An upper crimp seal 49, previously placed on the overhead tie 13, will slide down over the doubled back lower end 45. A conventional crimp tool will crimp the crimp seal 49 in the same manner as the crimp seal 37. The upper ends 51 of the upper reinforcing piece 47 will be within the loop and spaced below the lower end of the upper crimp seal 49.

Figure 4:
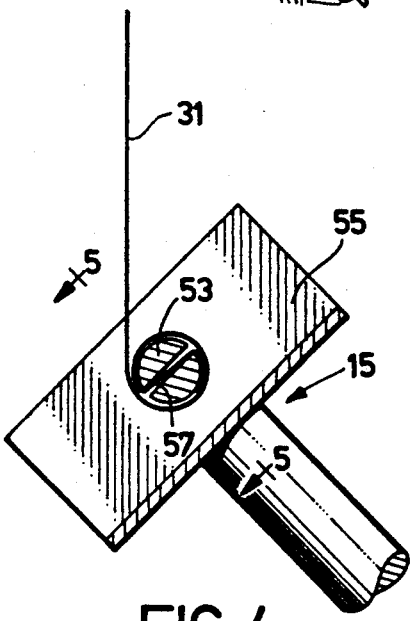
FIG. 4 is a partial sectional view of the lower end of the extender assembly of FIGS. 2 and 3, and the upper end of an anchor.
Figure 5:
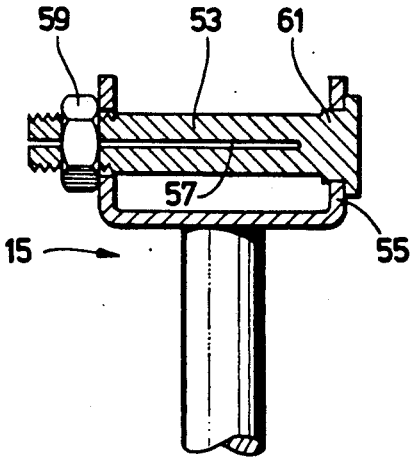
FIG. 5 is a reduced partial sectional view of the anchor of FIG. 4, taken along the line V—V, and shown with the extender strap removed.

The extender strap 31 has a lower end that will connect to anchor 15 in a conventional manner, as shown in FIG. 4. Referring also to FIG. 5, the anchor 15 has an upper section which carries a bolt 53. Bolt 53 mounts between two parallel side plates 55. Bolt 53 is split, having a slot 57 extending through it. The extender strap 31 will insert through the slot 57. A worker will rotate the bolt 53 to wrap the extender strap 31 around the bolt 53. This secures the extender strap 31 to the anchor 15 and tightens it. Once tight, the worker pushes inward on the bolt 53 and tightens a nut 59. A square shank 61 of the bolt 53 locks into a square hole in one of the side plates 55 to lock the bolt 53 against rotation.

In use, a manufacturer will fabricate the extender strap 31 with an extender plate 25 and a reinforcing piece 35. The persons setting up the mobile home 11 will take one of the extender straps 31 for each end of each overhead tie 13 that is too short to connect to an anchor 15. When at the site, he will insert the crimp seal 49 over the lower end 45 of the overhead tie 13. He will cut off a reinforcing piece 47 from a portion of the extender strap 31. He will insert the end 45 through the slot 27. He will insert the reinforcing piece 47 through the slot 27. He will bend both pieces back double. The operator slides the crimp seal 49 down over the doubled back end 45. Using a conventional crimp tool, he will crimp the end 45 to the overhead tie 13.

The operator then will connect the extender strap 31 to the anchor 15 as illustrated in FIG. 4. He inserts the end of extender strap 31 through slot 57. He rotates the bolt 53 to tighten the strap 31. He pushes the bolt shank 61 into the square hole in the side plate 55 and tightens the nut 59. He will then connect conventional frame straps (not shown) from the anchors 15 to the frame 12.

The invention has significant advantages. Using an extender plate with crimped ends provides the necessary strength to meet state specifications. This allows previously cut overhead ties to be utilized by extending the shortened ends.

While the invention has been shown in only one of its forms, it should be apparent to those skilled in the art that it is not so limited, but is susceptible to various changes without departing from the scope of the invention.

We claim:

1. A method of anchoring a mobile building; said mobile building having an upper structure and lower side edges; said mobile building having a steel overhead tie extending over the upper structure of the mobile building and downward past lower side edges of the mobile building, wherein a shortened lower end of the overhead tie has been previously cut too short to connect to an anchor embedded in the ground, the method comprising in combination:

providing a steel extender strap with an upper end and a lower end;

providing a steel extender plate having two slots;

looping the upper end of the extender strap through one of the slots;

crimping the upper end of the extender strap to secure the extender plate to the extender strap;

looping the shortened lower end of the overhead tie through the other slot in the extender plate;

crimping the shortened lower end of the overhead tie to secure the overhead tie to the extender plate; and connecting the lower end of the extender strap to the anchor.

2. A method of anchoring a mobile building; said mobile building having an upper structure and lower side edges; said mobile building having a steel overhead tie extending over the upper structure of the mobile building and downward past said lower side edges of the mobile building, wherein a shortened lower end of the overhead tie has been previously cut too short to connect to an anchor embedded in the ground, the method comprising in combination:

providing a steel extender strap with an upper end and a lower end;

providing a steel extender plate having an upper slot and a lower slot;

inserting the upper end of the extender strap through the lower slot;

inserting a lower reinforcing piece through the lower slot along with the upper end of the extender strap;

bending the upper end of the extender strap and the lower reinforcing piece over to form a loop through the lower slot, with the upper end of the extender strap doubled back into contact with the extender strap;

sliding a lower crimp seal over the doubled back upper end of the extender strap and crimping the lower crimp seal around the upper end of the extender strap to secure the extender plate to the extender strap;

inserting the shortened lower end of the overhead tie through the upper slot of the extender plate;

inserting an upper reinforcing piece through the upper slot along with the shortened lower end of the overhead tie;

bending the shortened lower end of the overhead tie and the upper reinforcing piece over to form a loop through the upper slot, with the shortened lower end of the overhead tie doubled back into contact with the overhead tie;

sliding an upper crimp seal over the doubled back shortened lower end of the overhead tie and crimping the upper crimp seal around the shortened lower end of the overhead tie to secure the overhead tie to the extender plate; and connecting the lower end of the extender strap to the anchor.

3. The method according to claim 2 wherein the lower reinforcing piece has a length selected so that when crimping the lower crimp seal, the ends of the lower reinforcing piece will be spaced above the lower crimp seal, and wherein the upper reinforcing piece has a length selected so that when crimping the upper crimp seal, the ends of the upper reinforcing piece will be spaced below the upper crimp seal.

4. An apparatus for anchoring a mobile building; said mobile building having an upper structure and lower side edges; said mobile building having a steel overhead tie extending over the upper structure of the mobile building and downward past said lower side edges of the mobile building, wherein a shortened lower end of the overhead tie has been previously cut too short to connect to an anchor embedded in the ground, the apparatus comprising in combination:

a steel extender strap with an upper end and a lower end:

a steel extender plate having two slots;

the upper end of the extender strap being looped through one of the slots and crimped to secure the extender plate to the extender strap;

the shortened lower end of the overhead tie being looped through the other slot in the extender plate and crimped to secure the overhead tie to the extender plate; and the lower end of the extender strap being connected to the anchor.

5. An apparatus for anchoring a mobile building; said mobile building having an upper structure and lower side edges; said mobile building having a steel overhead tie extending over the upper structure of the mobile building and downward past said lower side edges of the mobile building, wherein a shortened lower end of the overhead tie has been previously cut too short to connect to an anchor embedded in the ground, the apparatus comprising in combination:

a steel extender strap with an upper end and a lower end;

a steel extender plate having an upper slot and a lower slot;

the upper end of the extender strap being inserted through the lower slot and bent doubled back;

a lower reinforcing piece inserted through the lower slot along with the upper end of the extender strap and bent doubled back;

a lower crimp seal located over the doubled back upper end of the extender strap and crimped around the upper end of the extender strap to secure the extender plate to the extender strap;

the shortened lower end of the overhead tie being inserted through the upper slot and bent doubled back;

an upper reinforcing piece inserted through the upper slot along with the shortened lower end of the overhead tie and bent doubled back;

an upper crimp seal located over the doubled back shortened lower end of the overhead tie and crimped to secure the overhead tie to the extender plate; and means for connecting the lower end of the extender strap to the anchor.

6. The apparatus according to claim 5 wherein the lower reinforcing piece has ends spaced above the crimped lower crimp seal, and wherein the upper reinforcing piece has ends spaced below the crimped upper crimp seal.

* * * * *